United States Patent [19]

Combs

[11] Patent Number: 4,828,074

[45] Date of Patent: May 9, 1989

[54] TRUCK SCAFFOLDING

[76] Inventor: Linsey L. Combs, Rte. 4, Box 185, Holdenville, Okla. 74848

[21] Appl. No.: 261,690

[22] Filed: Oct. 24, 1988

[51] Int. Cl.[4] ..... E06C 5/00; E04G 1/24

[52] U.S. Cl. ..... 182/152; 182/63; 182/127

[58] Field of Search ..... 182/127, 152, 178, 179, 182/63

[56] References Cited

U.S. PATENT DOCUMENTS

| | | | |
|---|---|---|---|
| 3,110,359 | 11/1963 | Solomon | 182/127 |
| 3,186,512 | 6/1965 | Johnson | 182/152 |
| 3,217,449 | 11/1965 | Levere | 182/178 |
| 3,406,784 | 10/1968 | Jones | 182/127 |
| 3,967,327 | 6/1976 | Severson | 182/152 |
| 4,620,608 | 11/1986 | Gilbreath | 182/127 |
| 4,696,374 | 9/1987 | Hale | 182/127 |

*Primary Examiner*—Reinaldo P. Machado

[57] ABSTRACT

A portable scaffold in sections to be secured to the top of a pick-up bed sidewall. The scaffold has a lower section with a base to be secured to the top edge of the sidewall, upstanding vertical posts and cross members between the posts. An upper section, similar to the lower section, is hinged to the top of the vertical posts so that it may swing from a hanging down storage position to a vertical positon which a sleeve over the aligned posts couples the upper and lower sections together. Cross braces add rigidity to the erected scaffold. The upper scaffold section can also be supported by separate adjustable braces in a horizontal or other intermediate positions as it rotates about the hinge.

7 Claims, 2 Drawing Sheets

TRUCK SCAFFOLDING

BACKGROUND OF THE INVENTION

This invention relates to a collapsible truck scaffolding. In particular, it relates to a scaffold that may be mounted in a pickup truck bed for both transport and use. Still more particularly, this invention relates to a swivel device which facilitates the storage, transport, erection and use of a portable scaffolding system.

There are many types of scaffolds in use today, however they all require disassembly for transport then on-site assembly for use. Moreover, the prior scaffolds, once assembled cannot be changed in form, i.e. increase height, without additional disassembly and reassembly.

The prior art suggests various methods for providing a collapsible and/or portable scaffolding system. Some of which are very basic while others are more complicated. Examples of the above can be found in U.S. Pat. Nos. 3,566,990, 4,138,046, and 4,381,123. However, none of the above patents provide the ease and versatility disclosed herein.

BRIEF DESCRIPTION OF THE INVENTION

It is a primary object of this invention to provide a collapsible scaffold that may, in its collapsed mode, become an integral part of a truck bed yet be readily available for immediate erection and use.

Another object is to provide a scaffold that may be erected from its storage or transport mode into a variety of forms and heights for use.

A related but integral object is to provide a scaffold that is secured to a truck bed during use yet, at the same time, be easily moved about the site.

Still another object is to provide a connecting swivel arrangement that is used in conjunction with the scaffolding to facilitate its transport to and its erection and use on a job site.

Briefly, the foregoing and probably other objects are attained by a multiple section scaffold that may be folded essentially vertically flat for storage, but which may be erected either with its sections at right angles to each other to provide an elongated horizontal framework or extended with all its sections in a vertical plane to provide increased height.

In the preferred embodiment, a separate scaffold is secured to both sidewalls of a pickup truck bed and, when erected, is capable of receiving overlying planks in either a vertical or horizontal mode. In special cases, a single scaffold may be secured to the pickup tailgate and planks extended between it and the truck cab.

The scaffold of this invention has several means for securing it to the bed of a pickup truck. For example, the user may employ a pair of downward extending posts that are received in and fixed to the usual back pocket on the bed's side wall. One or more "C" clamps can then be used to augment the securing process. In cases where the scaffold is not placed conveniently close to the pockets, then "C" clamps alone or other fastening means may be used to secure the frame to the truck's bed. Of course the scaffold may be bolted to the truck bed or permanently fixed to the bed as by welding.

Rigidity is provided by fixing cross-bracing members which extend between the separate scaffolds after they are secured to the truck.

In order that the invention may be more readily understood and carried into effect, reference is made to the accompanying drawings and description thereof which are offered by way of example only and not in limitation of the invention. The scope of which is defined by the appended claims and equivalents embraced therein rather than any mere description thereof.

DETAILED DESCRIPTION OF THE INVENTION

The scaffold is made in sections, generally designated 10. Each section is adapted to be mounted on the top of a sidewall 11 of truck bed 12.

Figure 5:
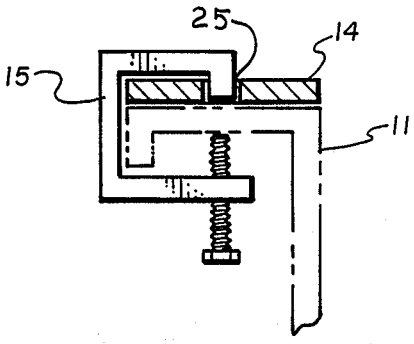
FIG. 5 is an enlarged view of the material enclosed in circle 5 of FIG. 1.
Figure 7:
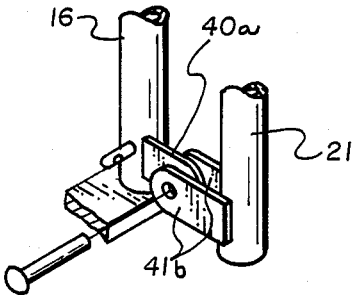
FIG. 7 is an enlarged view of a mechanism used in sowing the scaffolding in a vertical position.

Each scaffold section comprises a lower framework 13 and an upper framework 18. The lower framework 13 has a flat base 14 adapted to be secured to the top of the sidewall 11. Conventional "C" clamps 15 are used when a more permanent mount is undesirable. (See FIG. 5) The "C" clamps are used in conjunction with holes or cavities 25 bored in the flat base 14. Vertical posts 16 extend from the opposite ends of the base 14. A plurality of cross members 17 parallel to the base are connected between the vertical posts 16. In summary, each lower framework basically includes a flat base, 14 vertical posts 16 and cross members 17 all welded to form a single unit.

The second or upper framework 18 is connected to the lower framework by hinges 19 connected to the top of the vertical posts 16 and the bottom of side posts 21. (Best shown in FIG. 2) The hinges will be described in more detail later in the disclosure. The upper framework includes basically side posts 21 and cross members 22 which are welded to each other to form another single unit.

Figure 1:
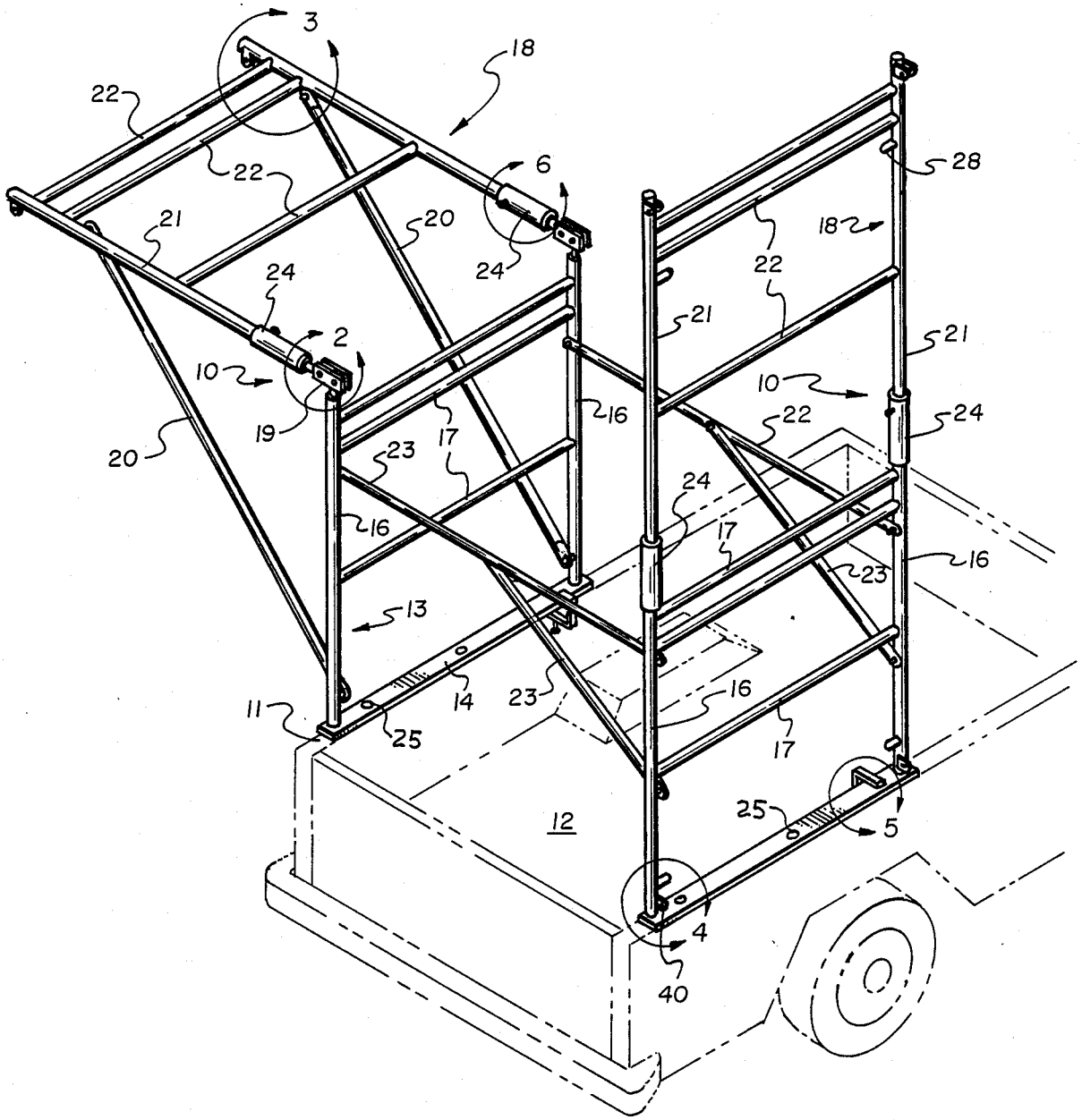
FIG. 1 is a perspective view of two scaffold sections assembled on either side of a truck bed. For illustrative purposes, to show the scaffolds in alternate modes, one scaffold is in a vertical position while the other is in a horizontal position. Normally only one mode is used at a single time. The truck cab has been omitted for clarity.
Figure 3:
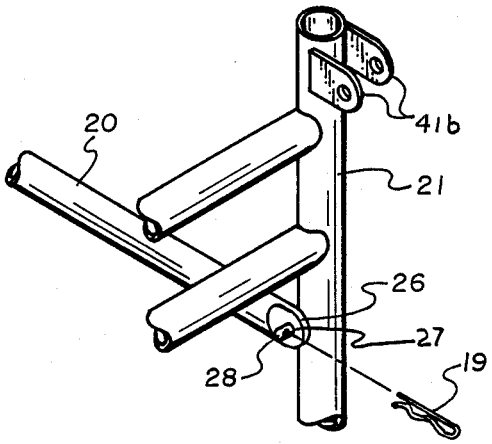
FIG. 3 is an enlarged view of the material enclosed in circle 3 of FIG. 1.
Figure 4:
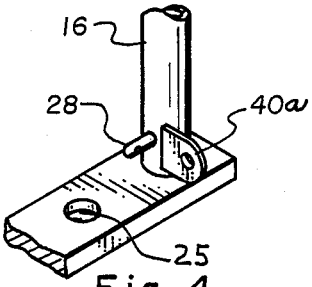
FIG. 4 is an enlarged view of the material enclosed in circle 4 of FIG. 1.

Separate horizontal tubular braces 23 having flattened end extensions 26 secure and stabilize the two scaffold sections 13 together. As shown in FIG. 3 the flattened ends have apertures 27 for receiving shafts or pins 28 fixed to the side posts 21 and the vertical posts 16. The braces are secured to the shafts by cotters passing through holes 30 located at the end of each shaft. (See FIG. 3 as an example) When the scaffold is at full vertical height as shown at the right of FIG. 1, then separate diagonal braces 23 will be used on both the upper and lower sections. If the scaffold is in the alternate mode, i.e. horizontal, as shown at the left of FIG. 1, the upper framework 18 will be supported in the horizontal position by additional cross braces 20 as shown best in FIG. 3. The cross braces contain flattened end extensions 26 and are fixed to the vertical posts 16 and side posts 21 by means of shafts or pins 28 and cotters 19 as previously described.

Figure 6:
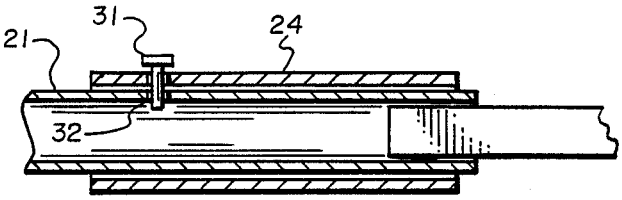
FIG. 6 is an enlarged view of the material enclosed in circle 6 of FIG. 1.

Rigidity is achieved for the full vertical position by the sleeves 24 slidably fitted on the side posts 21. When the lower vertical posts 16 and the upper side posts 21 are aligned, the sleeves 24 slide over the hinges 19 onto the posts 16 and 21 totally encompassing the hinges. The position of the cross members 17 limit the downward movement of sleeve 24. Additional or alternate stops could be used if the cross members are not located as shown. For example, the arrangement shown in FIG. 6 may be used.

* When the scaffold is in the horizontal mode, the sleeve 24 will circumscribe a portion of hinge 19. The sleeve is stabilized by the use of a locking pin 31, which passes through aligned openings 32 in sleeve 24 and side post 21. (see FIG. 6)

Referring now to FIG. 3 hinge 19 comprises a pair of rectangular swing links 33 and 34 having apertures 35 and 36 located at each of its ends. At the upper end of vertical post 16, an elongated metal plate 39 is inserted and fixed inside post 16. A short section of the plate extends outwardly to provide a flattened extension or bracket 39. This bracket contains an opening 38. A similar arrangement is utilized for the bottom end of side post 21 and thereby provide a second bracket or flattened extension 37. Bolts, 40 and cotters, 41 are provided to pivotally connect vertical post, 16 and side post 21.

Figure 2:
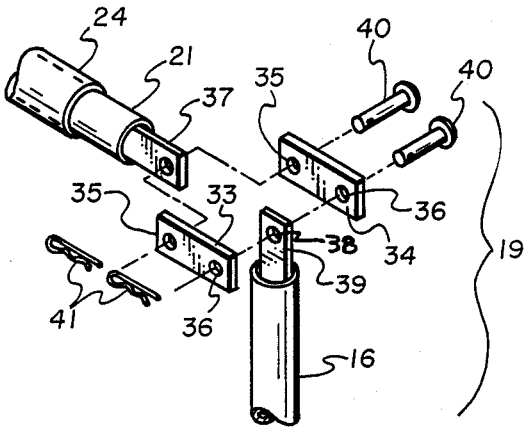
FIG. 2 is an enlarged view of the material enclosed in circle 2 of FIG. 1.

With the use of the hinging arrangement shown in FIG. 2 it is possible for the upper framework to take on three independent positions with respect to the lower framework, i.e., upright vertical, horizontal and downward vertical. In the downward vertical position, the upper framework can be stored either within or outside of the truck's bed.

When the upper framework is stored outside of the truck's bed, apertured male tabs **40*a* are provided at the base of the lower framework for receiving an apertured female tab system, 41*b***. A pin and cotter may be used to secure the upper framework to the lower framework during storage and travel.

The erected scaffold will support planks as needed. It may also be moved on the site while erected, but for normal transport, the upper framework will be folded down and stowed as heretofore been described.

The scaffold will be sized, to accommodate jobs most likely to be encountered. In all cases however, it should be sized to fit in a pickup bed. The scaffolding system just described can be used in fields for picking fruit or for making repairs on barns and buildings. In addition, when the scaffolds are in its stored position, the scaffolding can be used as extended walls on the pick-up. If a tarp is placed over the scaffolding, the bed can be used as a camping enclosure.

I claim:

1. A portable scaffold made from sections attachable to the walls of a pickup truck bed each section comprising a lower framework having a base member adapted to be secured to the upper edge of one of said side walls said base having vertical post extending from each of its opposite ends, a plurality of cross members connected between said vertical posts, an upper framework comprising parallel side posts connected by cross members, said upper framework being the same width as said lower framework, a pivotal means connecting the lower end of said side posts of said upper framework to the upper end of said vertical posts on said lower framework whereby said upper framework may be pivoted on said means between a fold position substantially face to face with said lower framework to a fully erect position wherein said vertical posts of the lower framework are coaxial with said sideposts of said upper framework, a sleeve slidably fitted on the lower end of said side posts of said upper framework and adapted when said posts are co-axially aligned as aforesaid to slide over said hinge and be simultaneously concentric with said upper and lower ends of said co-axially aligned posts, a plurality of diagonal support braces, connection means on said upper and lower framework adapted to provide connection of said diagonal support braces at a point adjacent to the base on said lower scaffold section and at a point near the far end of said upper scaffold section when the latter is in a plane other than aligned with said lower scaffold section.

2. The portable scaffold of claim 1 wherein said side post and said vertical post includes a first flattened extension extending outwardly from on end of said side post and a second flattened extension extending outwardly from an end of said vertical post each of said flattened extension adopted to connect with said pivotal means.

3. The portable scaffold of claim 2 wherein said pivotal means includes a pair of rectangular swing links each pivotally connected at their ends to each side of said flattened extensions extending outwardly from said vertical post and said side post.

4. The portable scaffold of claim 1 including a locking means for stowing said upper framework to said lower framework in a vertical position wherein said upper framework is positioned adjacent to said lower framework in a plane outside of said trucks bed.

5. The portable scaffold of claim 4 wherein said locking means includes apertured male tabs fixed to said vertical post near said base of said lower framework and a set of appertured female tabs secured in a mating relationship by a pin passing through the apertured male tabs and the apertured female tabs.

6. The portable scaffold of claim 1 wherein said sleeve includes an opening in alignment with an opening in said side post for receiving a locking pin and thereby secure said sleeve to said side post when said upper framework is positioned in a plane substantially perpendicular to said lower framework.

7. The portable scaffold of claim 1 wherein said lower framework is secured to said truck bed by "C" clamps passing through openings in said base member.

* * * * *